US006994170B2

(12) United States Patent
Echols

(10) Patent No.: US 6,994,170 B2
(45) Date of Patent: Feb. 7, 2006

(54) EXPANDABLE SAND CONTROL SCREEN ASSEMBLY HAVING FLUID FLOW CONTROL CAPABILITIES AND METHOD FOR USE OF SAME

(75) Inventor: Ralph H. Echols, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 133 days.

(21) Appl. No.: 10/448,009

(22) Filed: May 29, 2003

(65) Prior Publication Data

US 2004/0238168 A1 Dec. 2, 2004

(51) Int. Cl.
*E21B 33/127* (2006.01)
*E21B 43/08* (2006.01)
*E21B 43/00* (2006.01)

(52) U.S. Cl. ..... 166/386; 166/53; 166/141; 166/207; 166/236; 166/242.1; 166/250.15; 166/278

(58) Field of Classification Search ..... 166/278, 166/227, 250.01, 250.15, 277, 381, 386, 166/53, 191, 187, 141, 169, 206, 207, 316, 166/236, 242.1
See application file for complete search history.

(56) References Cited

U.S. PATENT DOCUMENTS

| | | | | |
|---|---|---|---|---|
| 2,342,913 A | | 2/1944 | Williams et al. | |
| 2,344,909 A | | 3/1944 | Williams et al. | |
| 3,486,558 A | | 12/1969 | Maxwell | |
| 3,627,046 A | | 12/1971 | Miller et al. | |
| 3,865,188 A | | 2/1975 | Doggett et al. | |
| 4,185,806 A | * | 1/1980 | Dremann | 251/61.1 |
| 4,418,754 A | | 12/1983 | Stepp | |
| 4,428,428 A | | 1/1984 | Smyrl et al. | |
| 4,494,608 A | | 1/1985 | Williams et al. | |
| 4,627,488 A | | 12/1986 | Szarka | |
| 4,858,690 A | | 8/1989 | Rebardi et al. | |
| 4,886,432 A | | 12/1989 | Kimberlin | |
| 4,932,474 A | | 6/1990 | Schroeder, Jr. et al. | |
| 4,945,991 A | | 8/1990 | Jones | |
| 5,082,052 A | | 1/1992 | Jones et al. | |
| 5,113,935 A | | 5/1992 | Jones et al. | |
| 5,161,613 A | | 11/1992 | Jones | |
| 5,161,618 A | | 11/1992 | Jones et al. | |
| 5,314,015 A | * | 5/1994 | Streich et al. | 166/184 |

(Continued)

FOREIGN PATENT DOCUMENTS

| | | |
|---|---|---|
| EP | 0 431 162 | 6/1991 |

(Continued)

OTHER PUBLICATIONS

U.S. Appl. No. 10/252,621, Brezinski et al.

(Continued)

*Primary Examiner*—Jennifer H Gay
(74) *Attorney, Agent, or Firm*—Lawrence R. Youst

(57) ABSTRACT

A sand control screen assembly (60) comprises a base pipe (62) having at least one opening (64) that allows fluid flow therethrough and a filter medium (66) positioned about the exterior of the base pipe (62) that allows fluid flow therethrough and prevents particulate flow therethrough. An inflatable seal member (72) is disposed within the at least one opening (64) of the base pipe (62) and controls fluid flow through the at least one opening (64). An inflation fluid source (74) is in fluid communication with the inflatable seal member (72) and provides an inflation fluid to the inflatable seal member (72) to selectively urge the inflatable seal member (72) into sealing engagement with the at least one opening (64).

62 Claims, 8 Drawing Sheets

U.S. PATENT DOCUMENTS

| | | | | |
|---|---|---|---|---|
| 5,320,178 | A * | 6/1994 | Cornette | 175/19 |
| 5,333,688 | A | 8/1994 | Jones et al. | |
| 5,343,949 | A | 9/1994 | Ross et al. | |
| 5,355,953 | A | 10/1994 | Shy et al. | |
| 5,355,956 | A | 10/1994 | Restarick | |
| 5,390,966 | A | 2/1995 | Cox et al. | |
| 5,419,394 | A | 5/1995 | Jones | |
| 5,435,393 | A | 7/1995 | Brekke et al. | |
| 5,443,117 | A | 8/1995 | Ross | |
| 5,476,143 | A | 12/1995 | Sparlin et al. | |
| 5,515,915 | A | 5/1996 | Jones et al. | |
| 5,555,945 | A * | 9/1996 | Schultz et al. | 175/50 |
| 5,588,487 | A | 12/1996 | Bryant | |
| 5,636,691 | A | 6/1997 | Hendrickson et al. | |
| 5,642,781 | A * | 7/1997 | Richard | 166/231 |
| 5,676,208 | A | 10/1997 | Finley | |
| 5,722,490 | A | 3/1998 | Ebinger | |
| 5,730,223 | A | 3/1998 | Restarick | |
| 5,755,286 | A | 5/1998 | Ebinger | |
| 5,842,516 | A | 12/1998 | Jones | |
| 5,848,645 | A | 12/1998 | Jones | |
| 5,865,251 | A | 2/1999 | Rebardi et al. | |
| 5,868,200 | A | 2/1999 | Bryant et al. | |
| 5,890,533 | A | 4/1999 | Jones | |
| 5,896,928 | A | 4/1999 | Coon | |
| 5,906,238 | A * | 5/1999 | Carmody et al. | 166/53 |
| 5,921,318 | A | 7/1999 | Ross | |
| 5,934,376 | A | 8/1999 | Nguyen et al. | |
| 5,988,285 | A | 11/1999 | Tucket et al. | |
| 6,003,600 | A | 12/1999 | Nguyen et al. | |
| 6,047,773 | A | 4/2000 | Zeltmann et al. | |
| 6,059,032 | A | 5/2000 | Jones | |
| 6,116,343 | A | 9/2000 | Van Petegem et al. | |
| 6,125,933 | A | 10/2000 | Ross | |
| 6,220,345 | B1 | 4/2001 | Jones et al. | |
| 6,227,303 | B1 | 5/2001 | Jones | |
| 6,230,803 | B1 | 5/2001 | Morton et al. | |
| 6,302,208 | B1 | 10/2001 | Walker et al. | |
| 6,343,651 | B1 | 2/2002 | Bixenman | |
| 6,354,373 | B1 | 3/2002 | Vercaemer et al. | |
| 6,371,210 | B1 | 4/2002 | Bode et al. | |
| 6,457,518 | B1 | 10/2002 | Castano-Mears et al. | |
| 6,478,091 | B1 | 11/2002 | Gano | |
| 6,478,092 | B2 * | 11/2002 | Voll et al. | 166/378 |
| 6,488,082 | B2 | 12/2002 | Echols et al. | |
| 6,540,022 | B2 | 4/2003 | Dusterhoft et al. | |
| 6,557,634 | B2 | 5/2003 | Hailey, Jr. et al. | |
| 6,719,051 | B2 | 4/2004 | Hailey, Jr. et al. | |
| 6,776,241 | B2 * | 8/2004 | Castano-Mears et al. | 166/381 |
| 6,805,202 | B2 | 10/2004 | Gillespie et al. | |
| 2002/0074119 | A1 | 6/2002 | Bixenman et al. | |
| 2002/0092649 | A1 | 7/2002 | Bixenman et al. | |
| 2002/0096329 | A1 | 7/2002 | Coon et al. | |
| 2002/0125006 | A1 | 9/2002 | Hailey, Jr. et al. | |
| 2002/0125008 | A1 | 9/2002 | Wetzel et al. | |
| 2002/0157837 | A1 | 10/2002 | Bode et al. | |
| 2002/0174981 | A1 | 11/2002 | Den Boer et al. | |
| 2002/0189815 | A1 | 12/2002 | Johnson et al. | |
| 2003/0000701 | A1 | 1/2003 | Dusterhoft et al. | |
| 2003/0000875 | A1 | 1/2003 | Echols et al. | |
| 2003/0056947 | A1 | 3/2003 | Cameron | |
| 2003/0056948 | A1 | 3/2003 | Cameron | |
| 2003/0075324 | A1 | 4/2003 | Dusterhoft et al. | |
| 2003/0089496 | A1 | 5/2003 | Price-Smith et al. | |
| 2003/0141055 | A1 * | 7/2003 | Paluch et al. | 166/254.2 |
| 2003/0141061 | A1 * | 7/2003 | Hailey, Jr. et al. | 166/278 |
| 2003/0141062 | A1 | 7/2003 | Cowan et al. | |
| 2003/0188871 | A1 | 10/2003 | Dusterhoft et al. | |
| 2004/0020832 | A1 | 2/2004 | Richards et al. | |
| 2004/0035578 | A1 | 2/2004 | Ross et al. | |
| 2004/0035591 | A1 | 2/2004 | Echols | |
| 2004/0238168 | A1 * | 12/2004 | Echols | 166/278 |
| 2005/0016740 | A1 * | 1/2005 | Aldaz et al. | 166/387 |

FOREIGN PATENT DOCUMENTS

| | | |
|---|---|---|
| EP | 0 617 195 | 9/1994 |
| EP | 1 132 571 | 9/2001 |
| EP | 0 955 447 | 3/2004 |
| GB | 2 371 319 | 7/2002 |
| GB | 2 371 578 | 7/2002 |
| GB | 2 381 021 | 4/2003 |
| GB | 2 381 811 | 5/2003 |
| WO | WO 99/12630 | 3/1999 |
| WO | WO 00/061913 | 10/2000 |
| WO | WO 01/42620 | 6/2001 |
| WO | WO 02/44619 | 6/2001 |
| WO | WO 01/49970 | 7/2001 |
| WO | WO 01/14691 | 10/2001 |
| WO | WO 02/10554 | 2/2002 |
| WO | WO 02/055842 | 7/2002 |
| WO | WO 02/057594 | 7/2002 |

OTHER PUBLICATIONS

Restarick, H.L. of Otis Engineering Corp; "Mechanical Fluid-Loss Control Systems Used During Sand Control Operations"; 1992; pp. 21-36.

"Sand Control Screens"; Halliburton Energy Services, Inc.; 1994; 4 pages.

Ebinger, Charles D. of Ely & Associates Inc.; "Frac Pack Technology Still Evolving"; Oil & Gass Journal; Oct. 23, 1995; pp. 60-70.

Hailey, Travis et al. of Halliburton Energy Services Inc.; "Screenless Single Trip Multizone Sand Control Tool System Saves Rig Time"; Society of Petroleum Engineers Inc.; Feb. 2000; pp. 1-11.

"CAPS Sand Control Services for Horizontal Completions Improves Gravel Pack Reliability and Increases Production Potential from Horizontal Completions"; Halliburton Energy Services, Inc.; Aug. 2000; 2 pages.

"CAPS Concentria Annual Packing Service for Sand Control"; Halliburton Energy Services, Inc.; Aug. 2000; 4 pages.

Saldungaray, Pedro M. et al. of Schlumberger, "Simultaneous Gravel Packing and Filter Cake Removal in Horizontal Wells Applying Shunt Tubes and Novel Carrier and Breaker Fluid"; Mar. 2001: pp. 1-6.

"QUANTUM Zonal Isolation Tool"; pp. 12-13 of Sand Face Competions Catalog.

"Absolute Isolation System (ASI) Components"; Halliburton Energy Services, Inc.; pp. 5-28 of Downhole Sand Control Components.

"OSCA HPR-ISO System"; Technical Bulletin; 1 page.

"OSCA The ISO System"; Technical Bulletin; 1 page.

"OSCA Screen Communication System"; Technical Bulletin; 1 page.

"OSCA Pressure Actuated Circulating Valve"; Technical Bulletin; 1 page.

* cited by examiner 10
22
52
12
20
24
26
30
18
50
28
36
44
48
34
16
42
40
46
32
14
38

EXPANDABLE SAND CONTROL SCREEN ASSEMBLY HAVING FLUID FLOW CONTROL CAPABILITIES AND METHOD FOR USE OF SAME

TECHNICAL FIELD OF THE INVENTION

This invention relates, in general, to a sand control screen assembly positioned in a production interval of a wellbore and, in particular, to an expandable sand control screen assembly having fluid flow control capabilities for selectively permitting and preventing fluid flow therethrough.

BACKGROUND OF THE INVENTION

Without limiting the scope of the present invention, its background will be described with reference to producing fluid from a subterranean formation, as an example.

After drilling each of the sections of a subterranean wellbore, individual lengths of relatively large diameter metal tubulars are typically secured together to form a casing string that is positioned within each section of the wellbore. This casing string is used to increase the integrity of the wellbore by preventing the wall of the hole from caving in. In addition, the casing string prevents movement of fluids from one formation to another formation. Conventionally, each section of the casing string is cemented within the wellbore before the next section of the wellbore is drilled.

Once this well construction process is finished, the completion process may begin. The completion process comprises numerous steps including creating hydraulic openings or perforations through the production casing string, the cement and a short distance into the desired formation or formations so that production fluids may enter the interior of the wellbore. The completion process may also include installing a production tubing string within the well casing which is used to produce the well by providing the conduit for formation fluids to travel from the formation depth to the surface.

To selectively permit and prevent fluid flow into the production tubing string, it is common practice to install one or more sliding sleeve type flow control devices within the tubing string. Typical sliding sleeve type flow control devices comprise a generally tubular body portion having side wall inlet openings formed therein and a tubular flow control sleeve coaxially and slidably disposed within the body portion. The sleeve is operable for axial movement relative to the body portion between a closed position, in which the sleeve blocks the body inlet ports, and an open position, in which the sleeve uncovers the ports to permit fluid to flow inwardly therethrough into the interior of the body and thus into the interior of the production tubing string. The sliding sleeves thus function as movable valve elements operable to selectively permit and prevent fluid inflow. Generally, cylindrical shifter tools, coaxially lowered into the interior of the tubing string on a wireline or other conveyance, are utilized to shift selected ones of the sliding sleeves from their closed positions to their open positions, or vice versa, to provide subsurface flow control in the well.

It has been found, however, that typical sliding sleeve type flow control devices are not suitable in completions requiring sand control as they are not compatible with typical sand control screens. Recently, a device has been proposed that combines sand control and fluid flow control, which was disclosed in U.S. Pat. No. 5,896,928. Specifically, the device includes a generally tubular body for placement into the wellbore. The tubular body has a sand control screen at an outer surface for preventing sand from entering into the tubular body. After the fluid flows through the sand control screen it must pass through a labyrinth. A slidable sleeve on the labyrinth controls the fluid velocity therethrough. The slidable sleeve is moved by a remotely and electrically-operated device placed in the tubular body. The fluid leaving the labyrinth passes to the tubing string for carrying the fluid to the surface.

It has been found, however, the labyrinth type flow control devices are difficult and expensive to manufacture and can be unreliable under certain inflow conditions. Accordingly, need has arisen for a fluid flow control device for controlling the inflow of formation fluids in a completion requiring sand control. A need has also arisen for such a fluid flow control device that is not difficult or expensive to manufacture. Further, a need has arisen for such a fluid flow control device that is reliable in a variety of flow conditions.

SUMMARY OF THE INVENTION

The present invention disclosed herein comprises a sand control screen assembly having fluid flow control capabilities for controlling the inflow of formation fluids in completions requiring sand control and a method for use of the same. The sand control screen assembly of the present invention is not difficult or expensive to manufacture. In addition, the sand control screen assembly of the present invention is reliable in a variety of flow conditions.

The sand control screen assembly of the present invention comprises a base pipe having at least one opening that allows fluid flow therethrough and a filter medium positioned about the exterior of the base pipe that allows fluid flow therethrough but prevents particulate flow therethrough. An inflatable seal member is disposed within the at least one opening of the base pipe. The inflatable seal member controls fluid flow through the at least one opening of the base pipe. An inflation fluid source in fluid communication with the inflatable seal member provides an inflation fluid to the inflatable seal member to selectively urge the inflatable seal member into sealing engagement with the at least one opening to thereby prevent fluid flow therethrough.

In one embodiment, the at least one opening has a contoured rim that urges the inflatable seal member to remain disposed within the at least one opening. In another embodiment, a retainer member positioned within the at least one opening urges the inflatable seal member to remain disposed within the at least one opening. In yet another embodiment, a retainer member positioned on a side wall of the base pipe around the at least one opening urges the inflatable seal member to remain disposed within the at least one opening. In addition, the inflatable seal member may comprise a resilient material that urges the inflatable seal member away from sealing engagement with the at least one opening.

In one embodiment, the inflation fluid source may comprise a tubing network positioned between the base pipe and the filter medium. In another embodiment, the inflation fluid source comprises a tubing network positioned within grooves in the base pipe. In either embodiment, the tubing network may extend from the surface to the sand control screen assembly. In addition, a check valve may be positioned in the tubing network proximate the inflatable seal member that allows the inflation fluid to flow into the inflatable seal member but prevents the inflation fluid from flowing out of the inflatable seal member.

The sand control screen assembly of the present invention may be run downhole as part of a spoolable coiled tubing. Thereafter, the sand control screen assembly of the present invention may be radially expanded downhole. In addition, the sand control screen assembly of the present invention may include a sensor operably associated with the inflation fluid source that monitors at least one downhole parameter and provides a signal to the inflation fluid source to urge the inflatable seal member into sealing engagement with the at least one opening.

In another aspect, the present invention involves a method for controlling the fluid flow through a sand control screen assembly. The method comprises providing a sand control screen assembly including a base pipe having at least one opening that allows fluid flow therethrough and a filter medium positioned about the exterior of the base pipe, positioning the sand control screen assembly downhole and selectively urging an inflatable seal member disposed within the at least one opening into sealing engagement with the at least one opening by providing an inflation fluid to the inflatable seal member from an inflation fluid source. The method may also comprise the step of unspooling the sand control screen assembly to run it downhole and the step of radially expanding the sand control screen assembly downhole.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
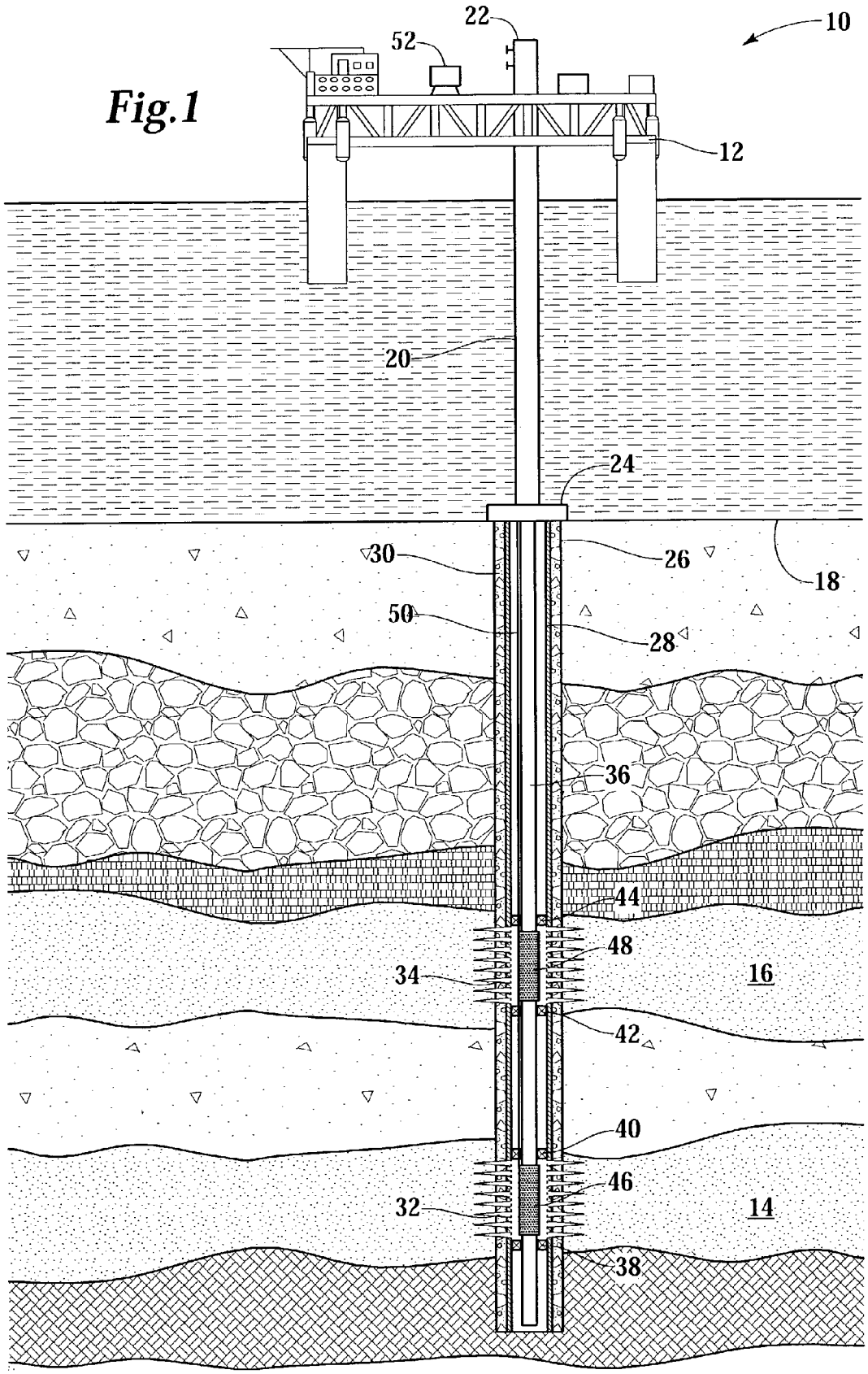
FIG. 1 is a schematic illustration of an offshore oil and gas platform operating a plurality of expandable sand control screen assemblies having fluid flow control capabilities according to the present invention.

Referring initially to FIG. 1, an offshore oil and gas platform operating a plurality of sand control screen assemblies having fluid flow control capabilities is schematically illustrated and generally designated 10. A semi-submersible platform 12 is centered over submerged oil and gas formations 14, 16 located below sea floor 18. A subsea conduit 20 extends from a wellhead installation 22 to a subsea installation 24. A wellbore 26 extends through the various earth strata including formations 14, 16. A casing string 28 is cemented within wellbore 26 by cement 30. Casing string 28 includes perforations 32 and perforations 34 that respectively allow formation fluids from formations 14, 16 to enter the interior of casing string 28.

Positioned within casing string 28 and extending from wellhead installation 22 is a tubing string 36. Tubing string 36 provides a conduit for formation fluids to travel from formations 14, 16 to the surface. A pair of packers 38, 40 provide a fluid seal between tubing string 36 and casing string 28 and define a production interval adjacent to formation 14. Likewise, packers 42, 44 provide a fluid seal between tubing string 36 and casing string 28 and define a production interval adjacent to formation 16.

Positioned within tubing string 36 in the production interval adjacent to formation 14 is a sand control screen assembly having fluid flow control capabilities 46. Likewise, positioned within tubing string 36 in the production interval adjacent to formation 16 is a sand control screen assembly having fluid flow control capabilities 48. It should be noted that sand control screen assemblies 46, 48 and tubing string 36 may be constructed from a plurality of joints that are threadably coupled together. Alternatively, sand control screen assemblies 46, 48 and tubing string 36 may be formed as a spoolable coiled tubing that is run downhole. A control line 50 extends from a surface installation 52 to provide power, communications and operating fluid to sand control screen assemblies 46, 48. Control line 50 and surface installation 52 allow for the independent control of each sand control screen assembly 46, 48.

It should be understood by those skilled in the art that even though FIG. 1 has depicted one sand control screen assembly associated with each production interval, any number of sand control screen assemblies could alternatively be used in association with each production interval without departing from the principles of the present invention. In such configurations, control line 50 and surface installation 52 allow for the independent control of each sand control screen assembly within each production interval. For example, certain ones of the sand control screen assemblies within a particular production interval may be used to close off certain sections of the production interval adjacent to a formation to prevent the production of water or other undesirable fluids.

It should be understood by those skilled in the art that even though FIG. 1 has depicted an offshore production operation, the sand control screen assemblies of the present invention are equally well suited for onshore operations. Also, even though FIG. 1 has depicted a vertical wellbore, the sand control screen assemblies of the present invention are equally well suited for use in wellbores having other directional configuration such as incline wellbores, deviated wellbores or horizontal wellbores. Further, even though FIG. 1 has depicted a cased wellbore, the sand control screen assemblies of the present invention are equally well suited for use in open hole completions due to the expansion capabilities of the sand control screen assemblies of the present invention which allow the sand control screen assemblies of the present invention to directly support the wall of the wellbore.

Figure 2:
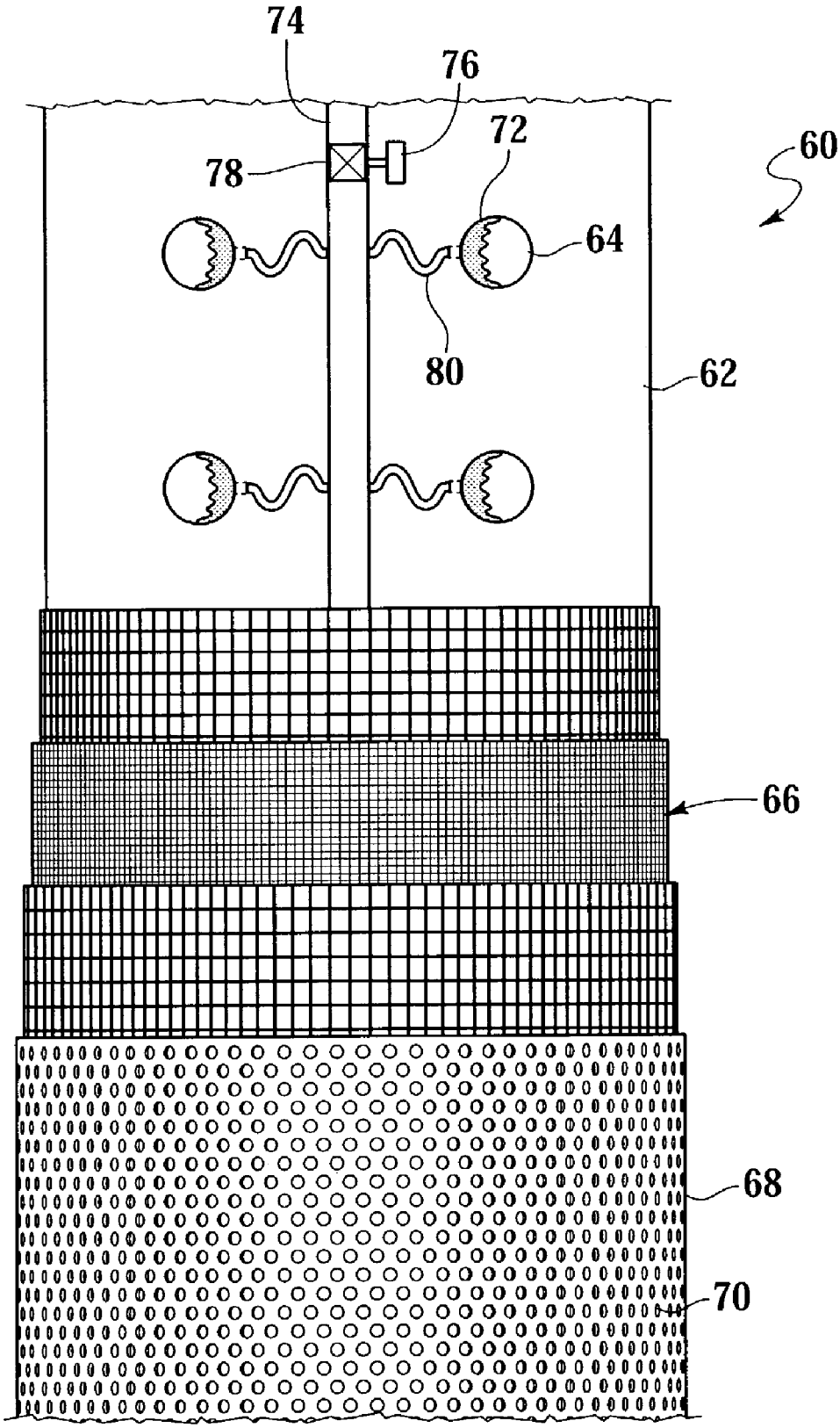
FIG. 2 is a partial cut away view of an expandable sand control screen assembly having fluid flow control capabilities according to the present invention in its unexpanded configuration.

Referring next to FIG. 2, a sand control screen assembly of the present invention is depicted and generally designated 60. Sand control screen assembly 60 includes a base pipe 62 that has a plurality of openings 64 that allow the flow of production fluids into the production tubing. Even though openings 64 are depicted as round openings, it should be understood by those skilled in the art that openings of other configurations may alternatively be used and are considered within the scope of the present invention. For example, openings 64 could alternatively have a non circular shape such as an oval shape, a square shape, a rectangular shape or other similar shapes. Accordingly, the term openings as used herein is intended to encompass any type of discontinuity in base pipe 62 that allows for the flow of fluids therethrough including, but not limited to, perforations, holes and slots of any configuration that are presently known in the art or subsequently discovered. In addition, the exact number and size of opening 64 are not critical to the present invention, so long as sufficient area is provided for fluid production and the integrity of base pipe 62 is maintained.

Positioned around base pipe 62 is a filter medium 66. In the illustrated embodiment, filter medium 66 is a fluid-porous, particulate restricting material such as a plurality of layers of a wire mesh that are diffusion bonded or sintered together to form a porous wire mesh screen designed to allow fluid flow therethrough but prevent the flow of particulate materials of a predetermined size from passing therethrough. Disposed around filter medium 66 is an outer shroud 68. Outer shroud 68 has a plurality of openings 70 which allow the flow of production fluids therethrough. The exact number, size and shape of openings 70 are not critical to the present invention, so long as sufficient area is provided for fluid production and the integrity of outer shroud 68 is maintained. Outer shroud 68 is designed to protect filter medium 66 during installation of sand control screen assembly 60 into the wellbore as well as during production therethrough.

It should be understood by those skilled in the art that even though a specific filter medium that is particularly well suited for use in expandable embodiments of the present invention has been depicted, other types of filter media could alternatively be used including, but not limited to, a wire wrap type filter medium. In addition, it should be understood by those skilled in the art that even though a filter medium is depicted as being positioned around the tubular having openings, the present invention is equally well-suited for use in a flow control device that does not include sand control capabilities.

Positioned within each of the openings 64 of base pipe 62 is an inflatable seal member 72. Inflatable seal members 72 selectively permit and prevent fluid flow between the interior and the exterior of sand control screen assembly 60. In the illustrated embodiment, inflatable seal members 72 are flush mounted within openings 64. Preferably, inflatable seal members 72 are constructed from a resilient material such as a rubber or other natural or synthetic polymer or similar material capable of deformation and elastic recovery. Inflatable seal members 72 may include a spring or other biasing member disposed therein to further enhance the resilient recovery of inflatable seal members 72. In addition, inflatable seal members 72 may alternatively be constructed from pliable metallic material. Also, it should be noted by those skilled in the art that even though inflatable seal members 72 are operably associated by base pipe 62, the inflatable seal members of the present invention could also be used in associated with other tubular structures including, for example, outer shroud 68.

Positioned between base pipe 62 and filter medium 66 is a control line 74. It should be noted that centralizers or other support members may be disposed between base pipe 62 and filter medium 66 to maintain the standoff therebetween. Alternatively, all or a portion of control line 74 may be run within a recess or channel in base pipe 62. As another alternative, control line 74 may be positioned on the exterior of filter medium 66 instead of between base pipe 62 and filter medium 66. In this configuration, control line 74 is preferably positioned in a recess or channel in filter medium 66. Control line 74 includes a variety of control capabilities such as electrical power via wirelines, communications via wirelines, fiber optic or the like and operating fluid via fluid conduits. Preferably, control line 74 runs from sand control screen assembly 60 to the surface such that the operations of sand control screen assembly 60 may be remotely controlled.

Operably associated with control line 74 are sensors 76. Sensors 76 may be used to monitor a variety of downhole parameters such as pressure, temperature, fluid composition and the like. Information gathered by sensors 76 may be transmitted to the surface and used to determine when to operate the flow control capabilities of sand control screen assembly 60. Positioned within a fluid conduit portion of control line 74 is a valve 78. Valve 78 selectively allows fluid communication between the fluid conduit portion of control line 74 and the interior of inflatable seal members 72. Valve 78 may be a single use valve such as a eutectic valve or may provide for multiple operations between its closed and open positions in which case the differential pressure between the control line pressure and the downhole hydrostatic pressure will operate on inflatable seal members 72 urging inflatable seal members 72 toward their open or closed positions. As an alternative, valve 78 may be a one-way valve or a one-way valve may be located at the surface location such that inflatable seal members 72 can be operated once from their open to their closed position. Extending between the fluid conduit portion of control line 74 and ports in the side wall of openings 64 are fluid conduits 80. In the illustrated embodiment, fluid conduits 80 have a curved configuration that allows for the radial expansion of sand control screen assembly 60.

Figure 3:
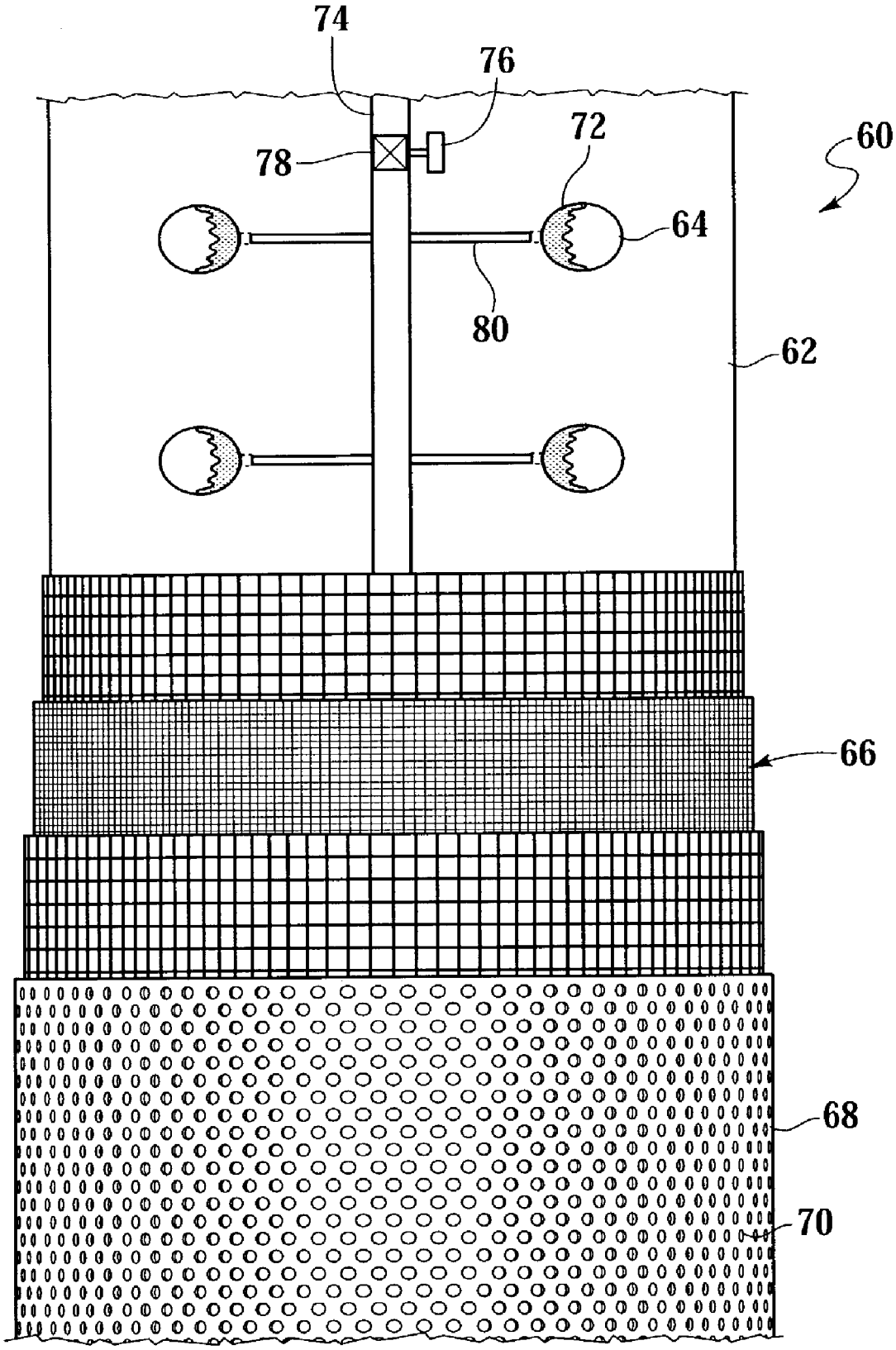
FIG. 3 is a partial cut away view of an expandable sand control screen assembly having fluid flow control capabilities according to the present invention in its expanded and open configuration.

Once sand control screen assembly 60 has been positioned downhole adjacent to a formation in a cased or uncased wellbore, sand control screen assembly 60 may be expanded to the configuration shown in FIG. 3. The expansion of sand control screen assembly 60 may progress from a downhole location to an uphole location by passing an expander mandrel therethrough or may progress from an uphole location to a downhole location using a telescoping expander member. For example, the expander member may include a tapered cone section, a piston section and an anchor section. The anchor section may include a receiver portion that is coupled to the lower end of coiled tubing string.

The expander member is operated by applying a downward force on the expander member by applying the weight of the coiled tubing string on the expander member. This downward force operates to stroke the piston to its compressed position. Once the piston completes its downward stroke, fluid is pumped down the coiled tubing string which sets the anchor section creating a friction grip between the anchor section and the interior of sand control screen assembly 60 which prevents upward movement of the anchor section. As more fluid is pumped down the coiled tubing string into the interior of the expander member, the fluid pressure urges the tapered cone section downwardly such that the tapered cone section places a radially outward force against the wall of sand control screen assembly 60 causing sand control screen assembly 60 to plastically deform. This process continues in a step wise fashion wherein each stroke of the expander member expands a section of sand control screen assembly 60. After the expansion process, the coiled tubing string and the expander member may be retrieved to the surface. Even though a particular expander member has been described, it should be understood by those skilled in the art that other methods of expansion could alternatively be used including, but not limited to, pulling an expander mandrel through sand control screen assembly 60 or positioning and inflating an expander bladder within sand control screen assembly 60.

As illustrated, when sand control screen assembly 60 is radially expanded, the curved sections of fluid conduits 80 are plastically deformed to compensate for the increase in the arc length between the fluid conduit portion of control line 74 and the ports in the side wall of openings 64 and such that fluid communication is maintained between the fluid conduit portion of control line 74 and inflatable seal members 72. Once sand control screen assembly 60 is in the expanded configuration, inflatable seal members 72 initially allow fluid flow through sand control screen assembly 60 and are actuatable to prevent fluid flow through sand control screen assembly 60.

Figure 4:
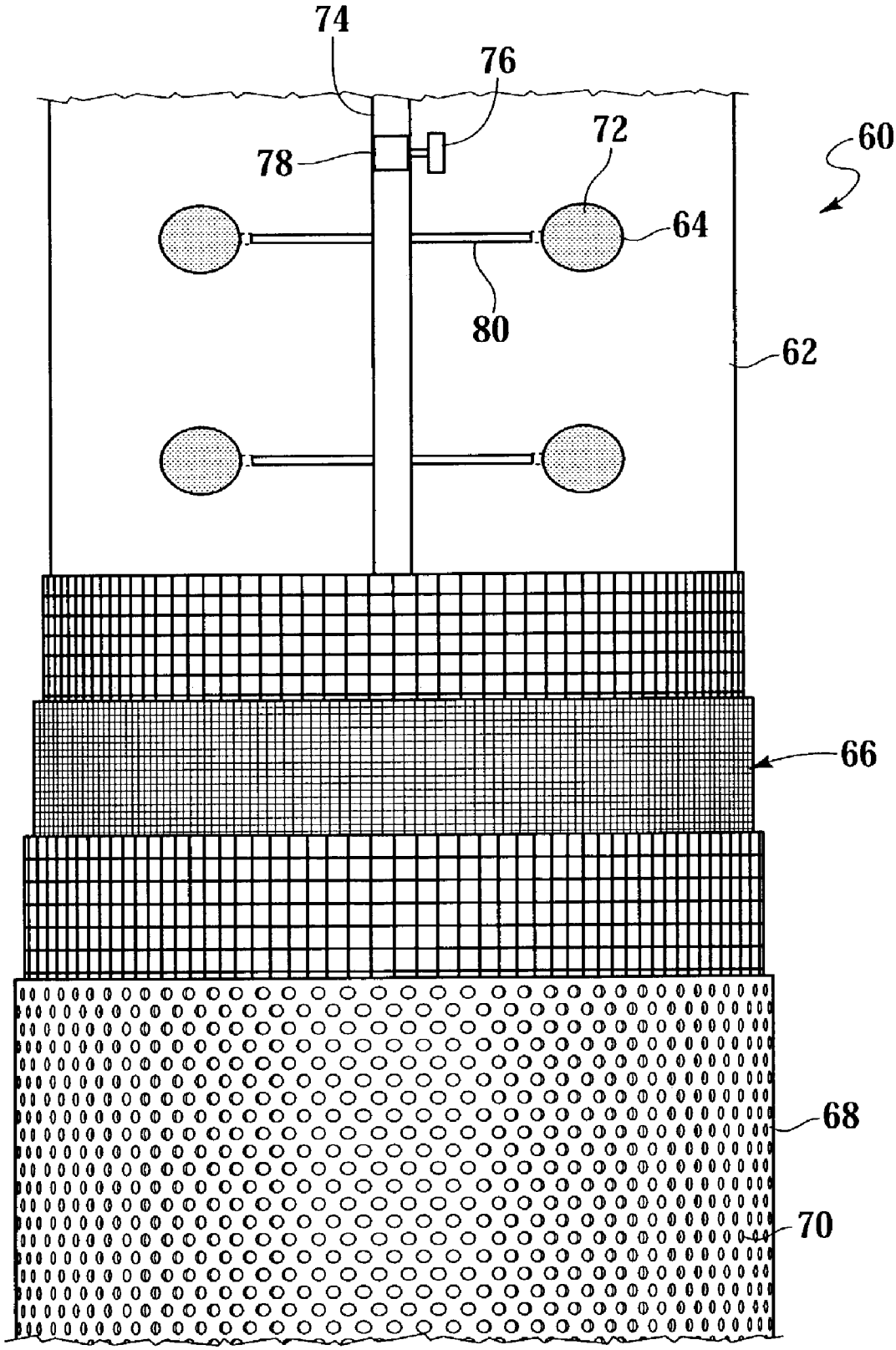
FIG. 4 is a partial cut away view of an expandable sand control screen assembly having fluid flow control capabilities according to the present invention in its expanded and closed configuration.

More specifically and referring both to FIGS. 3 and 4, sand control screen assembly 60 is used to filter particulate matter out of production fluids and control the flow of fluids into the tubing string. When inflatable seal members 72 of sand control screen assembly 60 are in their open position as depicted in FIG. 3, formation fluids are produced through filter medium 66 and openings 64 of base pipe 62. If it is determined that production through sand control screen assembly 60 should no longer continue, inflatable seal members 72 of sand control screen assembly 60 may be operated to their closed position as depicted in FIG. 4.

For example, if sensors 76 have sensed that the formation fluids being produced through sand control screen assembly 60 contain an undesirable percentage of water, then a signal may be sent to the surface via control line 74 indicating such a fluid composition. Thereafter, power may be sent to valve 78 via control line 74 and through appropriate switching or addressing circuitry such that valve 78 is operated from a closed position to an open position, thereby allowing fluid communication therethrough. Operating fluid from the fluid conduit portion of control line 74 then passes through fluid conduits 80 and the port in the side wall of openings 64 into the interior of inflatable seal members 72. Inflatable seal members 72 are thereby inflated into sealing engagement with the inner surface of the side walls of openings 64. Once in this configuration, fluid flow is no longer permitted through sand control screen assembly 60.

In some embodiments of the present invention, if it is desirable to reestablish fluid flow through sand control screen assembly 60, inflatable seal members 72 may be deflated to provide a fluid communication path between the exterior and the interior of sand control screen assembly 60 through openings 64. The deflation process involves reducing the pressure within the fluid conduit portion of control line 74 such that the pressure on the exterior of inflatable seal members 72 and the resilience of inflatable seal members 72 operate inflatable seal members 72 to the open position as depicted in FIG. 3.

Figure 5:
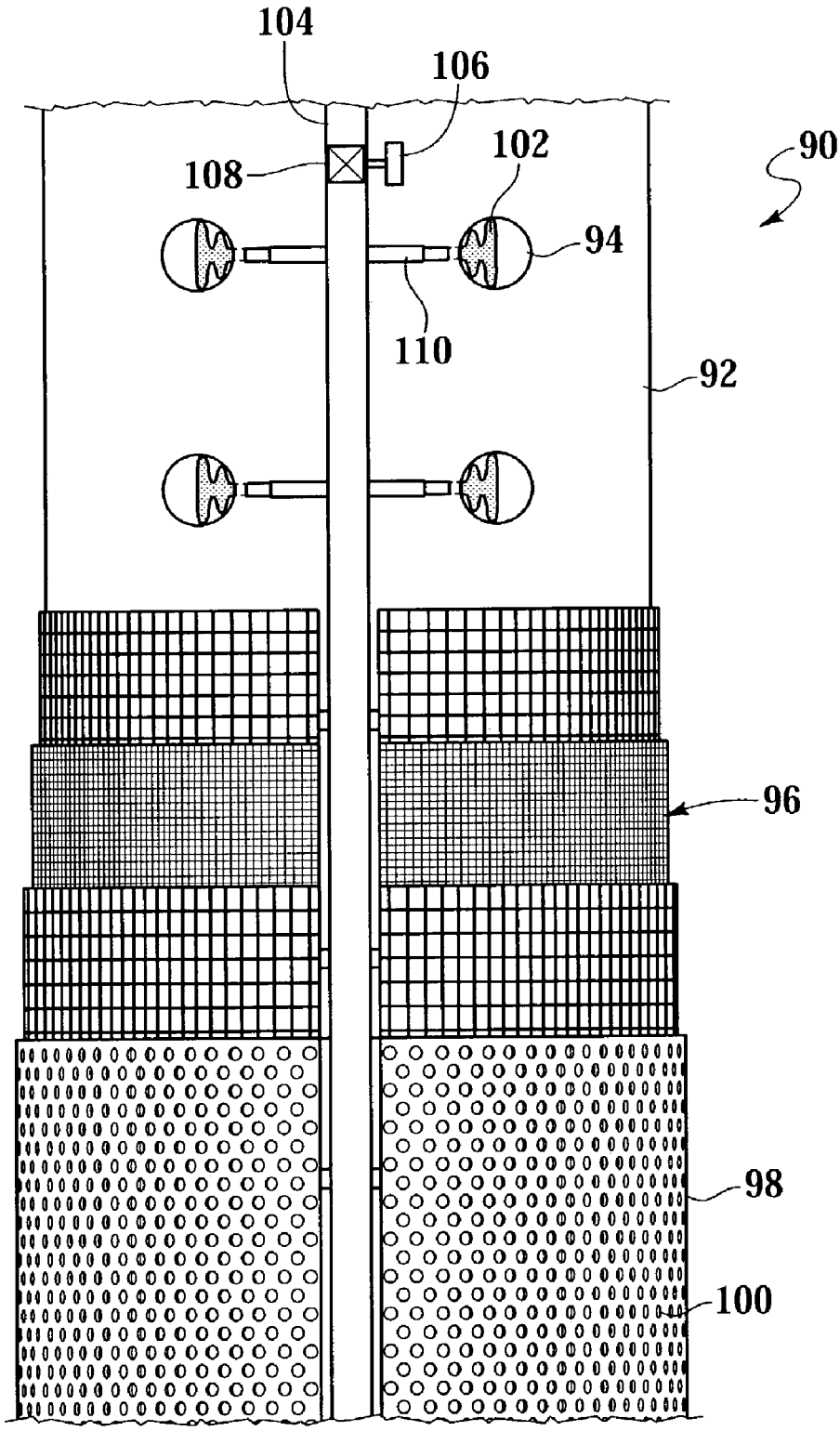
FIG. 5 is a partial cut away view of an expandable sand control screen assembly having fluid flow control capabilities according to the present invention in its unexpanded configuration.

Referring next to FIG. 5, a sand control screen assembly of the present invention is depicted and generally designated 90. Sand control screen assembly 90 includes a base pipe 92 that has a plurality of openings 94 that allow the flow of production fluids into the production tubing. Positioned around base pipe 92 is a filter medium 96. Disposed around filter medium 96 is an outer shroud 98. Outer shroud 98 has a plurality of openings 100 which allow the flow of production fluids therethrough.

Positioned within each of the openings 94 of base pipe 92 is an inflatable seal member 102. Inflatable seal members 102 selectively permit and prevent fluid flow between the interior and the exterior of sand control screen assembly 90. In the illustrated embodiment, inflatable seal members 102 are flush mounted within openings 94. Preferably, inflatable seal members 102 are constructed from a resilient material such as a rubber or other natural or synthetic polymer or similar material capable of deformation and elastic recovery. Inflatable seal members 102 may be constructed with a spring or other biasing member disposed therein to further enhance the resilient recovery of inflatable seal members 102.

Positioned in a recess in filter medium 96 is a control line 104. Control line 104 includes a variety of control capabilities such as electrical power via wirelines, communications via wirelines, fiber optic or the like and operating fluid via fluid conduits. Preferably, control line 104 runs from sand control screen assembly 90 to the surface such that the operations of sand control screen assembly 90 may be remotely controlled.

Operably associated with control line 104 are sensors 106 that may be used to monitor a variety of downhole parameters such as pressure, temperature, fluid composition and the like. Information gathered by sensors 106 may be transmitted to the surface and used to determine when to operate the flow control capabilities of sand control screen assembly 90. Positioned within a fluid conduit portion of control line 104 is a valve 108 that selectively allows fluid communication between the fluid conduit portion of control line 104 and the interior of inflatable seal members 102. Extending between the fluid conduit portion of control line 104 and ports in the side wall of openings 94 are fluid conduits 110. In the illustrated embodiment, fluid conduits 110 have telescoping sections that allows for the radial expansion of sand control screen assembly 90.

Figure 6:
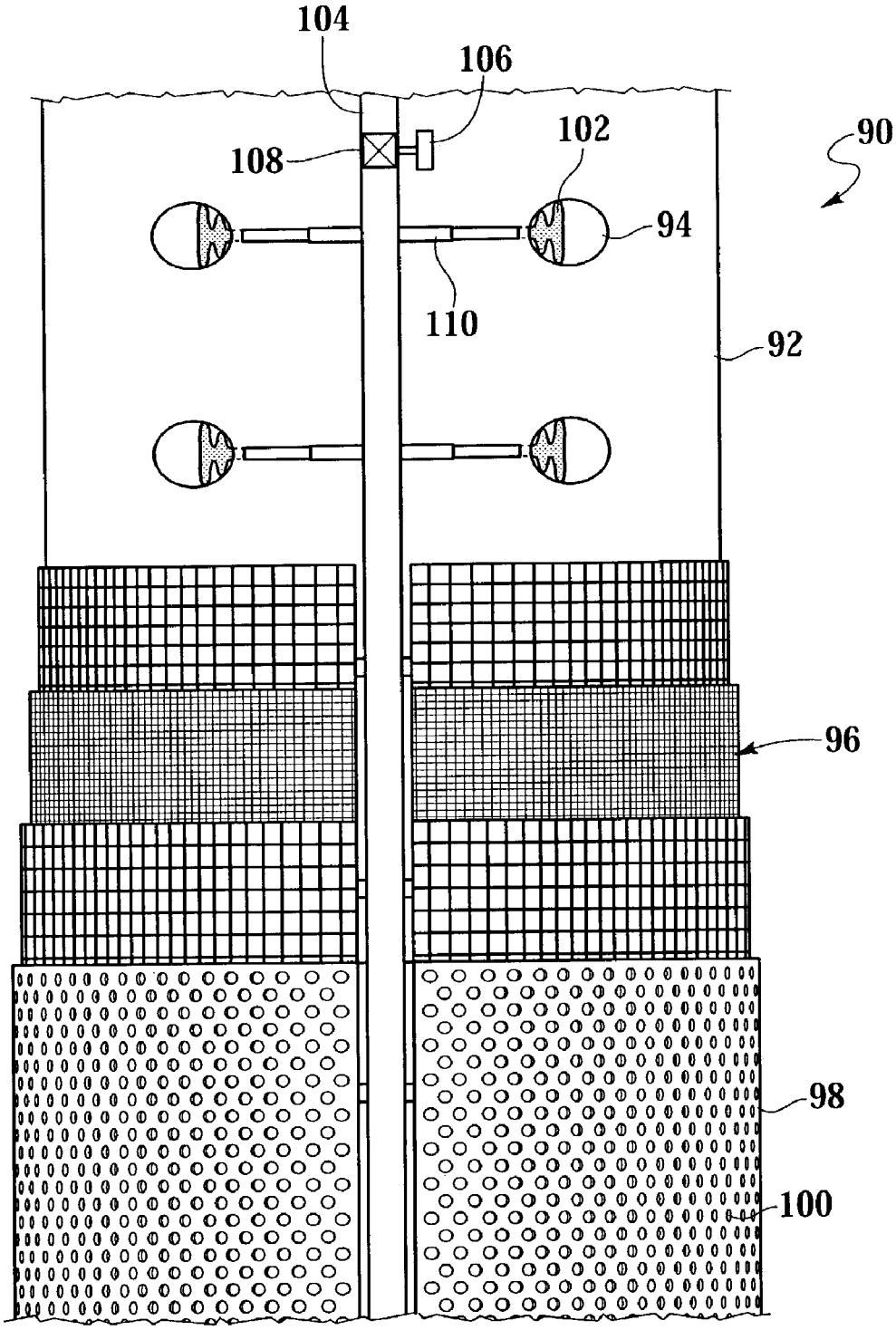
FIG. 6 is a partial cut away view of an expandable sand control screen assembly having fluid flow control capabilities according to the present invention in its expanded and open configuration.

Once sand control screen assembly 90 has been positioned downhole adjacent to a formation in a cased or uncased wellbore, sand control screen assembly 90 may be expanded to the configuration shown in FIG. 6. The expansion of sand control screen assembly 90 may progress from a downhole location to an uphole location by passing an expander mandrel therethrough or may progress from an uphole location to a downhole location using, for example, the telescoping expander member described above.

As illustrated, when sand control screen assembly 90 is radially expanded, the telescoping sections of fluid conduits 110 are extended to compensate for the increase in the arc length between the fluid conduit portion of control line 104 and the ports in the side wall of openings 94 and such that fluid communication is maintained between the fluid conduit portion of control line 104 and inflatable seal members 102. Once sand control screen assembly 90 is in the expanded configuration, inflatable seal members 102 initially allow fluid flow through sand control screen assembly 90 and are actuatable to prevent fluid flow through sand control screen assembly 90.

Figure 7:
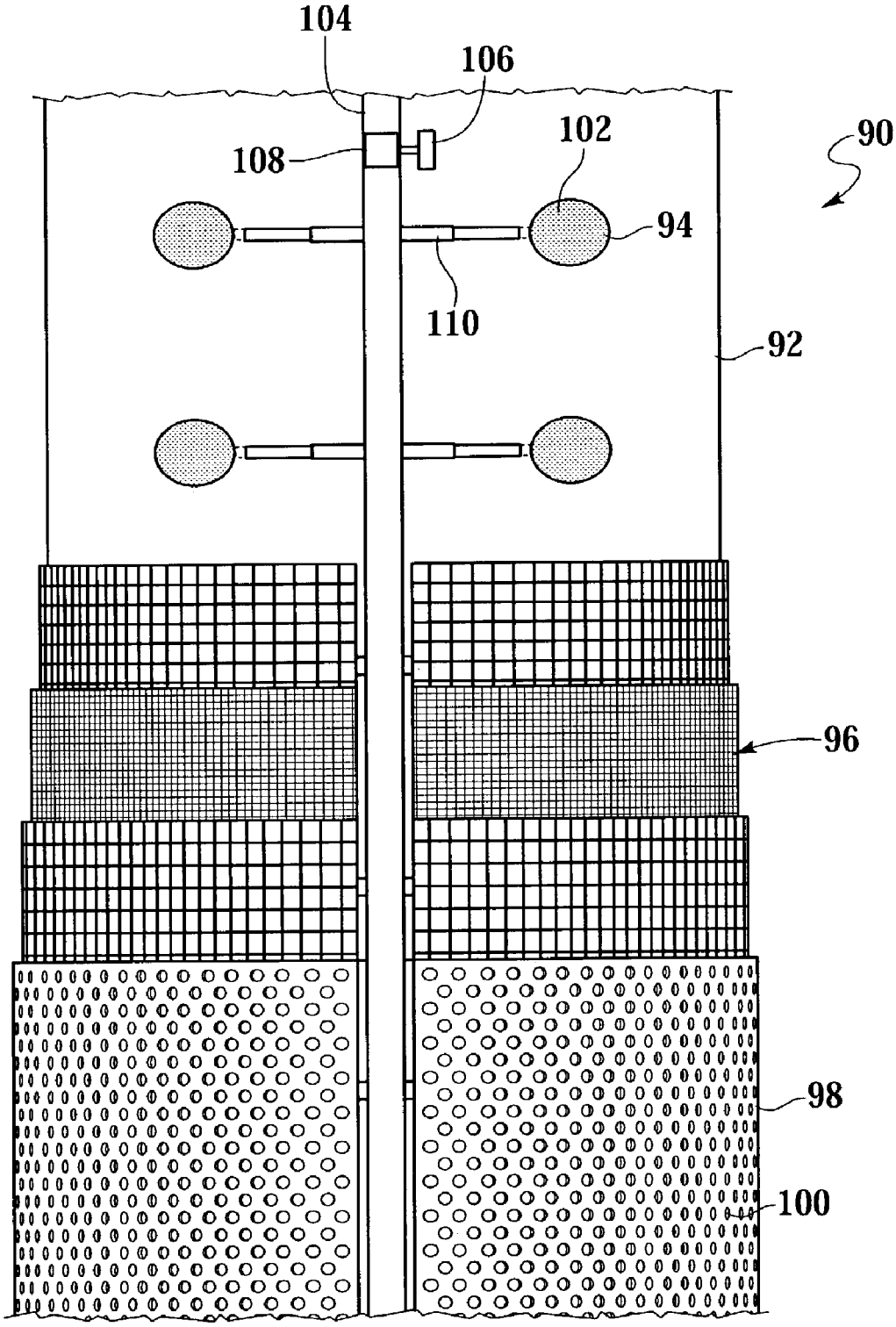
FIG. 7 is a partial cut away view of an expandable sand control screen assembly having fluid flow control capabilities according to the present invention in its expanded and closed configuration.

More specifically and referring both to FIGS. 6 and 7, sand control screen assembly 90 is used to filter particulate matter out of production fluids and control the flow of fluids into the tubing string. When inflatable seal members 102 of sand control screen assembly 90 are in their open position as depicted in FIG. 6, formation fluids are produced through filter medium 96 and openings 94 of base pipe 92. If it is determined that production through sand control screen assembly 90 should no longer continue, inflatable seal members 102 of sand control screen assembly 90 may be operated to their closed position as depicted in FIG. 7.

For example, if sensors 106 have sensed that the formation fluids being produced through sand control screen assembly 90 contain an undesirable percentage of water, then a signal may be sent to the surface via control line 104 indicating such a fluid composition. Thereafter, power may be sent to valve 108 via control line 104 and through appropriate switching or addressing circuitry such that valve 108 is operated from a closed position to an open position, thereby allowing fluid communication therethrough. Operating fluid from the fluid conduit portion of control line 104 then passes through fluid conduits 110 and the port in the side wall of openings 94 into the interior of inflatable seal members 102. Inflatable seal members 102 are thereby inflated into sealing engagement with the inner surface of the side walls of openings 94. Once in this configuration, fluid flow is no longer permitted through sand control screen assembly 90.

In some embodiments of the present invention, if it is desirable to reestablish fluid flow through sand control screen assembly 90, inflatable seal members 102 may be deflated to provide a fluid communication path between the exterior and the interior of sand control screen assembly 90 through openings 94. The deflation process involves reducing the pressure within the fluid conduit portion of control line 104 such that the pressure on the exterior of inflatable seal members 102 and the resilience of inflatable seal members 102 operate inflatable seal members 102 to the open position as depicted in FIG. 6.

Figure 8:
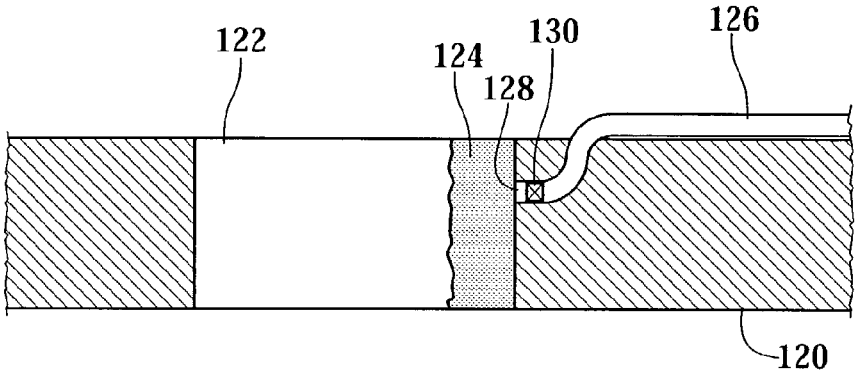
FIG. 8 is a cross sectional view of a base pipe opening having a seal member positioned therein in its open configuration of an expandable sand control screen assembly having fluid flow control capabilities according to the present invention.

Referring now to FIG. 8, therein is depicted a cross sectional view of a portion of a sand control screen assembly of the present invention. Base pipe 120 of the sand control screen assembly includes opening 122. Positioned within opening 122 is an inflatable seal member 124 in its non sealing position that operates in a manner described above. A fluid conduit 126 selectively provides operation or inflation fluid to inflatable seal member 124. In the illustrated embodiment, fluid conduit 126 is mounted on the outer surface of base pipe 120. A portion of fluid conduit 126 is also disposed within base pipe 120 and extends to a port 128 in the side wall of opening 122 that is in fluid communication with the interior of inflatable seal member 124. A one-way valve 130 is disposed within fluid conduit 126 that allows fluid flow from fluid conduit 126 into inflatable seal member 124 but prevents fluid flow from inflatable seal member 124 to fluid conduit 126. This embodiment of the sand control screen assembly of the present invention provides for a single operation of sand control screen assembly from a producing configuration to a non production configuration.

Figure 9:
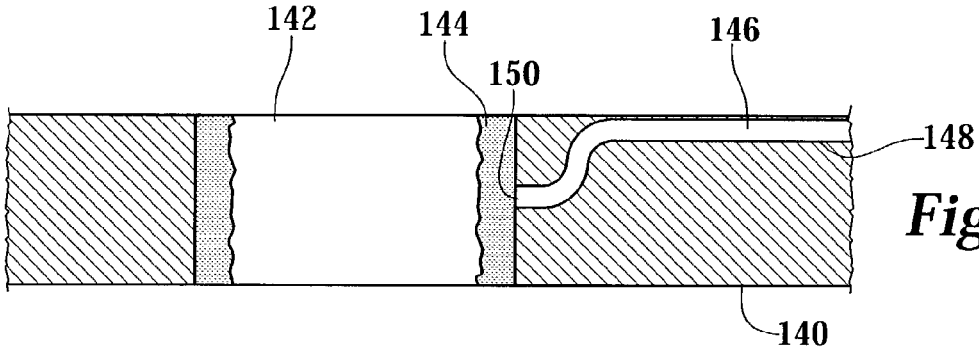
FIG. 9 is a cross sectional view of a base pipe opening having a seal member positioned therein in its open configuration of an expandable sand control screen assembly having fluid flow control capabilities according to the present invention.

Referring now to FIG. 9, therein is depicted a cross sectional view of a portion of another embodiment of a sand control screen assembly of the present invention. Base pipe 140 of the sand control screen assembly includes opening 142. Positioned within opening 142 is an annular inflatable seal member 144 in its non sealing position that operates in a manner described above. A fluid conduit 146 selectively provides operation or inflation fluid to inflatable seal member 144. In the illustrated embodiment, fluid conduit 146 is mounted within channels or recesses 148 on the outer surface of base pipe 140. A portion of fluid conduit 146 extends to a port 150 in the side wall of opening 144 that is in fluid communication with the interior of inflatable seal member 144.

Figure 10:
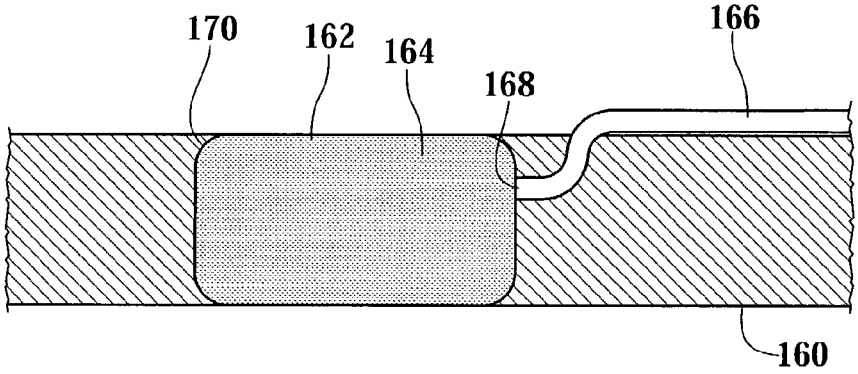
FIG. 10 is a cross sectional view of a base pipe opening having a seal member positioned therein in its closed configuration of an expandable sand control screen assembly having fluid flow control capabilities according to the present invention.

Referring now to FIG. 10, therein is depicted a cross sectional view of a portion of another embodiment of a sand control screen assembly of the present invention. Base pipe 160 of the sand control screen assembly includes opening 162. Positioned within opening 162 is an inflatable seal member 164 in its sealing position that operates in a manner described above. A fluid conduit 166 selectively provides operation or inflation fluid to inflatable seal member 164. In the illustrated embodiment, fluid conduit 166 is mounted on the surface of base pipe 160. A portion of fluid conduit 166 is also disposed within base pipe 160 and extends to a port 168 in the side wall of opening 164 that is in fluid communication with the interior of inflatable seal member 164. Opening 162 includes contoured inner and outer rims 170 that help retain inflatable seal member 164 within opening 162 when inflatable seal member 164 is in its sealing engagement with the side walls of opening 162.

Figure 11:
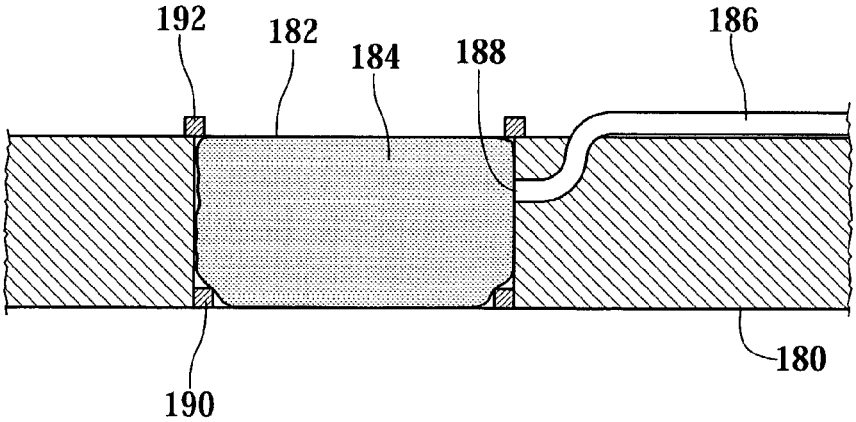
FIG. 11 is a cross sectional view of a base pipe opening having a seal member positioned therein in its closed configuration of an expandable sand control screen assembly having fluid flow control capabilities according to the present invention.

Referring now to FIG. 11, therein is depicted a cross sectional view of a portion of another embodiment of a sand control screen assembly of the present invention. Base pipe 180 of the sand control screen assembly includes opening 182. Positioned within opening 182 is an inflatable seal member 184 in its sealing position that operates in a manner described above. A fluid conduit 186 selectively provides operation or inflation fluid to inflatable seal member 184. In the illustrated embodiment, fluid conduit 186 is mounted on the surface of base pipe 180. A portion of fluid conduit 186 is also disposed within base pipe 180 and extends to a port 188 in the side wall of opening 184 that is in fluid communication with the interior of inflatable seal member 184. Opening 182 includes a retainer member 190 positioned therein proximate the inner portion of base pipe 180 and a retainer member 192 positioned on the outer surface of base pipe 180 partially over opening 182. Retainer members 190, 192 help retain inflatable seal member 184 with opening 182 when inflatable seal member 184 is in its sealing engagement with the side walls of opening 182.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A sand control screen assembly comprising:

a base pipe having at least one opening that allows fluid flow therethrough;

a filter medium positioned about the exterior of the base pipe, the filter medium allowing fluid flow therethrough and preventing particulate flow therethrough;

an inflatable seal member disposed within the at least one opening of the base pipe that controls fluid flow through the at least one opening of the base pipe; and an inflation fluid source in fluid communication with the inflatable seal member that provides an inflation fluid to the inflatable seal member to selectively urge the inflatable seal member into sealing engagement with the at least one opening.

2. The sand control screen assembly as recited in claim 1 wherein the at least one opening has a port in an inner surface thereof, the port providing fluid communication between the inflation fluid source and inflatable seal member.

3. The sand control screen assembly as recited in claim 1 wherein the at least one opening has a contoured rim that urges the inflatable seal member to remain disposed within the at least one opening.

4. The sand control screen assembly as recited in claim 1 further comprising a retainer member positioned within the at least one opening that urges the inflatable seal member to remain disposed within the at least one opening.

5. The sand control screen assembly as recited in claim 1 further comprising a retainer member positioned on a side wall of the base pipe around the at least one opening that urges the inflatable seal member to remain disposed within the at least one opening.

6. The sand control screen assembly as recited in claim 1 wherein the inflatable seal member further comprises a resilient material that urges the inflatable seal member away from sealing engagement with the at least one opening.

7. The sand control screen assembly as recited in claim 1 further comprising a check valve in fluid communication with the inflatable seal member that allows the inflation fluid to flow into the inflatable seal member but prevents the inflation fluid from flowing out of the inflatable seal member.

8. The sand control screen assembly as recited in claim 1 wherein the inflation fluid source further comprises a tubing network positioned between the base pipe and the filter medium.

9. The sand control screen assembly as recited in claim 1 wherein the inflation fluid source further comprises a tubing network positioned within grooves in the base pipe.

10. The sand control screen assembly as recited in claim 1 wherein the inflation fluid source further comprises a tubing network positioned at least partially within a recess in the filter medium.

11. The sand control screen assembly as recited in claim 1 wherein the sand control screen assembly is radially expandable.

12. The sand control screen assembly as recited in claim 1 further comprising a sensor operably associated with the inflation fluid source that monitors at least one downhole parameter and provides a signal to the inflation fluid source to urge the inflatable seal member into sealing engagement with the at least one opening.

13. An expandable sand control screen assembly comprising:

an expandable base pipe having at least one opening that allows fluid flow therethrough;

an expandable filter medium positioned about the exterior of the base pipe, the filter medium allowing fluid flow therethrough and preventing particulate flow therethrough;

an inflatable seal member disposed within the at least one opening of the base pipe that controls fluid flow through the at least one opening of the base pipe; and an inflation fluid source in fluid communication with the inflatable seal member that provides an inflation fluid to the inflatable seal member to selectively urge the inflatable seal member into sealing engagement with the at least one opening.

14. The expandable sand control screen assembly as recited in claim 13 wherein the at least one opening has a contoured rim that urges the inflatable seal member to remain disposed within the at least one opening.

15. The expandable sand control screen assembly as recited in claim 13 further comprising an expandable retainer member positioned within the at least one opening that urges the inflatable seal member to remain disposed within the at least one opening.

16. The expandable sand control screen assembly as recited in claim 13 further comprising an expandable retainer member positioned on a side wall of the base pipe around the at least one opening that urges the inflatable seal member to remain disposed within the at least one opening.

17. The expandable sand control screen assembly as recited in claim 13 wherein the inflatable seal member further comprises a resilient material that urges the inflatable seal member away from sealing engagement with the at least one opening.

18. The expandable sand control screen assembly as recited in claim 13 further comprising a check valve in fluid communication with the inflatable seal member that allows the inflation fluid to flow into the inflatable seal member but prevents the inflation fluid from flowing out of the inflatable seal member.

19. The expandable sand control screen assembly as recited in claim 13 wherein the inflation fluid source further comprises a tubing network positioned between the base pipe and the filter medium.

20. The expandable sand control screen assembly as recited in claim 13 wherein the inflation fluid source further comprises a tubing network positioned within grooves in the base pipe.

21. The expandable sand control screen assembly as recited in claim 13 wherein the inflation fluid source further comprises a tubing network positioned at least partially within a recess in the filter medium.

22. The expandable sand control screen assembly as recited in claim 13 wherein the inflation fluid source further comprises a tubing network extending to a surface location.

23. The expandable sand control screen assembly as recited in claim 13 wherein the inflation fluid source further comprises a tubing network having expandable sections.

24. The expandable sand control screen assembly as recited in claim 23 wherein the expandable sections of the tubing network are telescopically extendable.

25. The expandable sand control screen assembly as recited in claim 23 wherein the expandable sections of the tubing network are extendable by straighten curved sections.

26. The expandable sand control screen assembly as recited in claim 23 wherein the expandable sections of the tubing network are extendable by plastic deformation.

27. The expandable sand control screen assembly as recited in claim 13 further comprising a sensor operably associated with the inflation fluid source that monitors at least one downhole parameter and provides a signal to the inflation fluid source to urge the inflatable seal member into sealing engagement with the at least one opening.

28. A downhole tool comprising:

a tubular member having at least one opening in a sidewall portion thereof that allows fluid flow therethrough;

an inflatable seal member disposed within the at least one opening of the tubular member that controls fluid flow through the at least one opening of the tubular member; and an inflation fluid source in fluid communication with the inflatable seal member that provides an inflation fluid to the inflatable seal member to selectively urge the inflatable seal member into sealing engagement with the at least one opening.

29. The downhole tool as recited in claim 28 wherein the at least one opening has a port in an inner surface thereof, the port providing fluid communication between the inflation fluid source and inflatable seal member.

30. The downhole tool as recited in claim 28 wherein the at least one opening has a contoured rim that urges the inflatable seal member to remain disposed within the at least one opening.

31. The downhole tool as recited in claim 28 further comprising a retainer member positioned within the at least one opening that urges the inflatable seal member to remain disposed within the at least one opening.

32. The downhole tool as recited in claim 28 further comprising a retainer member positioned on the side wall of the tubular member around the at least one opening that urges the inflatable seal member to remain disposed within the at least one opening.

33. The downhole tool as recited in claim 28 wherein the inflatable seal member further comprises a resilient material that urges the inflatable seal member away from sealing engagement with the at least one opening.

34. The downhole tool as recited in claim 28 further comprising a check valve in fluid communication with the inflatable seal member that allows the inflation fluid to flow into the inflatable seal member but prevents the inflation fluid from flowing out of the inflatable seal member.

35. The downhole tool as recited in claim 28 wherein the tubular member is radially expandable.

36. The downhole tool as recited in claim 28 further comprising a sensor operably associated with the inflation fluid source that monitors at least one downhole parameter and provides a signal to the inflation fluid source to urge the inflatable seal member into sealing engagement with the at least one opening.

37. A method for controlling the fluid flow through a sand control screen assembly comprising the steps of:

providing the sand control screen assembly including a base pipe having at least one opening that allows fluid flow therethrough and a filter medium positioned about the exterior of the base pipe;

positioning the sand control screen assembly downhole; and selectively urging an inflatable seal member disposed within the at least one opening into sealing engagement with the at least one opening by providing an inflation fluid to the inflatable seal member from an inflation fluid source.

38. The method as recited in claim 37 wherein the step of providing an inflation fluid to the inflatable seal member from an inflation fluid source further comprises flowing the inflation fluid through a port in an inner surface of the at least one opening.

39. The method as recited in claim 37 further comprising the step of urging the inflatable seal member to remain disposed within the at least one opening with a contoured rim on the at least one opening.

40. The method as recited in claim 37 further comprising the step of urging the inflatable seal member to remain disposed within the at least one opening with a retainer member disposed within the at least one opening.

41. The method as recited in claim 37 further comprising the step of urging the inflatable seal member to remain disposed within the at least one opening with a retainer member positioned on a side wall of the base pipe around the at least one opening.

42. The method as recited in claim 37 further comprising the step of resiliently urging the inflatable seal member away from sealing engagement with the at least one opening.

43. The method as recited in claim 37 further comprising the step of urging the inflatable seal member away from sealing engagement with the at least one opening with downhole hydrostatic pressure.

44. The method as recited in claim 37 further comprising the step of preventing the inflation fluid from flowing out of the inflatable seal member with a check valve.

45. The method as recited in claim 37 wherein the step of providing an inflation fluid to the inflatable seal member from an inflation fluid source further comprises positioning a tubing network between the base pipe and the filter medium.

46. The method as recited in claim 37 wherein the step of providing an inflation fluid to the inflatable seal member from an inflation fluid source further comprises positioning a tubing network within grooves in the base pipe.

47. The method as recited in claim 37 wherein the step of providing an inflation fluid to the inflatable seal member from an inflation fluid source further comprises positioning a tubing network at least partially within a recess in the filter medium.

48. The method as recited in claim 37 wherein the step of providing an inflation fluid to the inflatable seal member from an inflation fluid source further comprises extending a tubing network from a surface location.

49. The method as recited in claim 37 further comprising the step of radially expanding the sand control screen assembly downhole.

50. The method as recited in claim 37 further comprising the step of monitoring at least one downhole parameter with a sensor and providing a signal to the inflation fluid source to urge the inflatable seal member into sealing engagement with the at least one opening.

51. A method for controlling the fluid flow through a sand control screen assembly comprising the steps of:

providing the sand control screen assembly including a base pipe having at least one opening that allows fluid flow therethrough and a filter medium positioned about the exterior of the base pipe;

positioning the send control screen assembly downhole;

radially expanding the sand control screen assembly donwhole; and selectively urging an inflatable seal member disposed within the at least one opening into sealing engagement with the at least one opening by providing an inflation fluid to the inflatable seal member from an inflation fluid source.

52. The method as recited in claim 51 further comprising the step of urging the inflatable seal member to remain disposed within the at least one opening with a contoured rim on the at least one opening.

53. The method as recited in claim 51 further comprising the step of urging the inflatable seal member to remain disposed within the at least one opening with a retainer member disposed within the at least one opening.

54. The method as recited in claim 51 further comprising the step of urging the inflatable seal member to remain disposed within the at least one opening with a retainer member positioned on a side wall of the base pipe around the at least one opening.

55. The method as recited in claim 51 further comprising the step of resiliently urging the inflatable seal member away from sealing engagement with the at least one opening.

56. The method as recited in claim 51 further comprising the step of urging the inflatable seal member away from sealing engagement with the at least one opening with downhole hydrostatic pressure.

57. The method as recited in claim 51 further comprising the step of preventing the inflation fluid from flowing out of the inflatable seal member with a check valve.

58. The method as recited in claim 51 wherein the step of providing an inflation fluid to the inflatable seal member from an inflation fluid source further comprises positioning a tubing network between the base pipe and the filter medium.

59. The method as recited in claim 51 wherein the step of providing an inflation fluid to the inflatable seal member from an inflation fluid source further comprises positioning a tubing network within grooves in the base pipe.

60. The method as recited in claim 51 wherein the step of providing an inflation fluid to the inflatable seal member from an inflation fluid source further comprises positioning a tubing network at least partially within a recess in the filter medium.

61. The method as recited in claim 51 wherein the step of providing an inflation fluid to the inflatable seal member from an inflation fluid source further comprises extending a tubing network from a surface location.

62. The method as recited in claim 51 further comprising the step of monitoring at least one downhole parameter with a sensor and providing a signal to the inflation fluid source to urge the inflatable seal member into sealing engagement with the at least one opening.

* * * * *